US006193620B1

(12) United States Patent
Tarng

(10) Patent No.: US 6,193,620 B1
(45) Date of Patent: Feb. 27, 2001

(54) MULTI-MEDIA FRISBEE-GOLF

(75) Inventor: Min Ming Tarng, San Jose, CA (US)

(73) Assignee: Tang System, San Jose, CA (US)

( * ) Notice: Subject to any disclaimer, the term of this patent is extended or adjusted under 35 U.S.C. 154(b) by 0 days.

(21) Appl. No.: 09/127,255

(22) Filed: Jul. 31, 1998

(51) Int. Cl.[7] ..... A63B 67/00
(52) U.S. Cl. ..... 473/465; 473/588
(58) Field of Search ..... 473/465, 588, 473/590; 124/5; 446/47, 46; 273/348.4

(56) References Cited

U.S. PATENT DOCUMENTS

| | | | | |
|---|---|---|---|---|
| 2,493,245 | * | 1/1950 | Hansen | 124/5 |
| 3,720,018 | * | 3/1973 | Peterson et al. | 446/47 |
| 3,786,246 | * | 1/1974 | Johnson et al. | 446/47 |
| 3,959,916 | * | 6/1976 | Meyer | 446/47 |
| 4,223,473 | * | 9/1980 | Brown | 446/46 |
| 4,290,226 | * | 9/1981 | Stauffer | 446/46 |
| 4,297,809 | * | 11/1981 | Branson | 446/46 |
| 4,357,020 | * | 11/1982 | Van Bryant, Jr. | 473/588 |
| 4,856,793 | * | 8/1989 | Hannifin | 473/590 |
| 4,869,699 | * | 9/1989 | Plambeck et al. | 446/47 |
| 4,889,347 | * | 12/1989 | Mineart | 473/588 |
| 5,032,098 | * | 7/1991 | Balogh et al. | 446/47 |
| 5,078,637 | * | 1/1992 | McFarland | 446/46 |
| 5,209,490 | * | 5/1993 | Dallavecchia | 273/348.4 |
| 5,261,846 | * | 11/1993 | Hanna | 446/46 |
| 5,287,561 | * | 2/1994 | Spector | 2/209.11 |
| 5,366,403 | * | 11/1994 | Weiss | 446/46 |
| 5,411,265 | * | 5/1995 | Falco | 473/196 |
| 5,611,720 | * | 3/1997 | Vandermaas | 446/47 |
| 5,630,742 | * | 5/1997 | Honaker | 446/46 |

* cited by examiner

*Primary Examiner*—Jeanette Chapman
*Assistant Examiner*—M. Chambers

(57) ABSTRACT

A multi-media flying-saucer-golf game comprises a golf-flying-saucer and flying-saucer pole. The golf-flying-saucer spins on the launching pad of the flying-saucer pole at high speed. Swinging the flying-saucer pole, the spinning golf-flying-saucer takes off from the launching pad of the flying-saucer pole. The golf-flying-saucer has the bell shape body with the flare wrapping around the ring band externally. The ring band has the foam segments wrapped around the tube externally. The player can catch the soft flying-saucer hat with his head. The size of the ring band can be adjusted with the interlocking means to fit the different size of the player's head. The vibration-energized LED installed in the transparent plastic tube of the ring band. The shining harmonica-whistles are installed on the golf-flying-saucer. As the golf-flying-saucer glides in the sky, the harmonica-whistle and the spinning color rainbow will attract many people's attention.

14 Claims, 10 Drawing Sheets

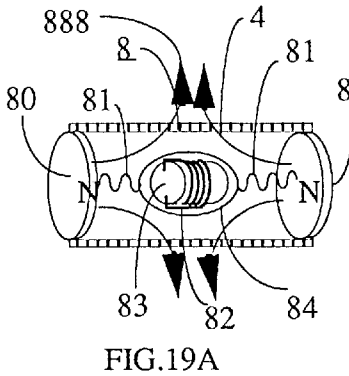
FIG.19A
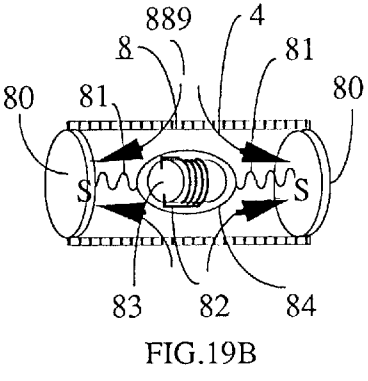
FIG.19B
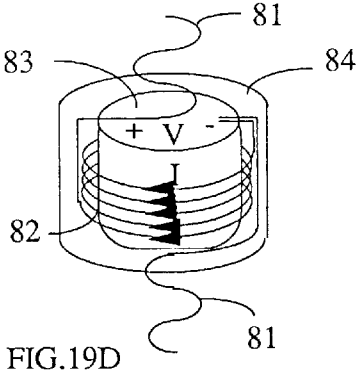
FIG.19D
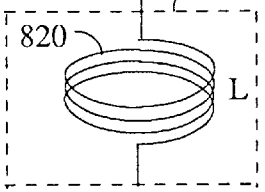
FIG.19E
FIG.19F
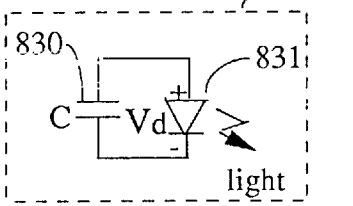
FIG.19G
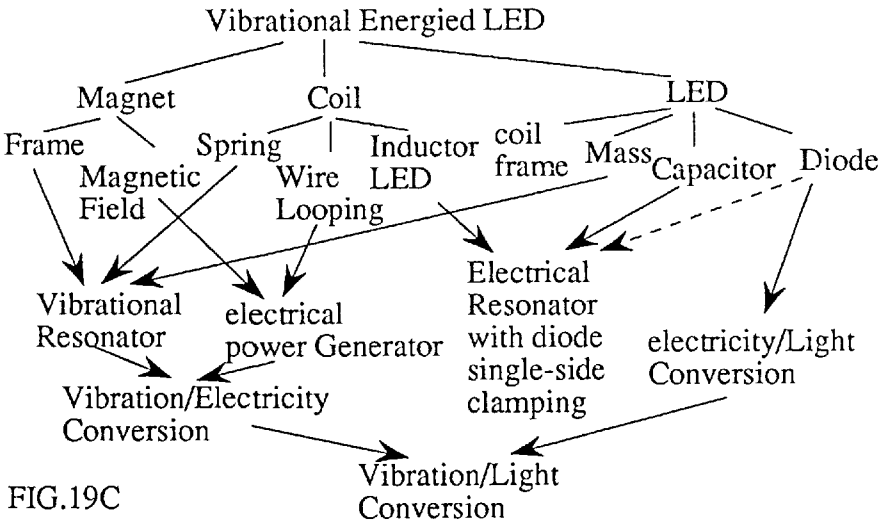
FIG.19C

MULTI-MEDIA FRISBEE-GOLF

BACKGROUND

1. Field of Invention

An adjustable flexible shining-rainbow multi-toning-harmonica-whistle variable-size golf-flying-saucer can be thrown with hand or flying-saucer-pole. The golf-flying-saucer can be caught with hand, head or flying-saucer-pole. The golf-flying-saucer can be put on a head as a flying-saucer hat. From child's head size to adult's head size, it can adjust its size for the different head size. As the flying-saucer sits on the launching pad of flying-saucer-pole, the player can turn the flying-saucer to rotate at high speed. Then the player throws the golf-flying-saucer into the sky with the swivel of the flying-saucer-pole. The flying-saucer whistles the harmonica sound in the sky. In the day time, under the sunshine, the spinning flying-saucer has the rainbow like color light; in the night, the flying-saucer shines the rotating LED light.

2. Description of Prior Art

Flying-saucer is a popular game in the park. However, the rotating speed of the flying-saucer is limited. The throwing distance of flying-saucer is limited. The ways to play with the flying-saucer are limited. To make the flying-saucer sport have more fun, we must enrich the ways to play with the flying-saucer. The golf field is a good place to play with the flying-saucer. To play with the flying-saucer in the golf field, the flying-saucer must be modified to be compatible with the game of golf. Combining the flying-saucer sport with the golf sport creates a new golf-flying-saucer sport. Swiveling the long flying-saucer-pole with the force of waist, the golf-flying-saucer can fly much higher in attitude and much longer in distance. It is enjoyable to observe the shining light and listen to the whistling sound as the golf-flying-saucer glides in the sky.

Furthermore, many new games can be generated. For example, we may combine the soccer with the game of golf. The golf-flying-saucer speed is much slower than the golf ball and the golf-flying-saucer is soft. Just as the soccer player does, the opponent can run after the gliding golf-flying-saucer to catch the golf-flying-saucer with his head. To catch the golf-flying-saucer with head, the golf-flying-saucer combines both the flying-saucer and the hat structure to create the flying-saucer-hat structure. As the opponent catches the golf-flying-saucer with his head, then the player loses the points. So the traditional single player of the game of golf becomes the team players of the game of golf-flying-saucer. The game of golf-flying-saucer is much safer and more enjoyable than the game of golf. The golf-flying-saucer glides and spins in the sky with shining rainbow like color light and with whistling sound of the harmonica-whistle in the daylight and in the night. To have more fun, the golf-flying-saucer can be caught with either a hand or a head. So the golf-flying-saucer is also mentioned as the flying-saucer hat.

3. Objects and Advantages

The golf-flying-saucer provides new games that the golf-flying-saucer can throw and catch with the hand, the head or the flying-saucer-pole. The golf-flying-saucer can rotate much faster and fly much higher in the sky than the conventional flying-saucer can. It generates versatile new games in the park and in the field of golf course.

DRAWING FIGURES

FIG. 18 (A) is the flying-saucer spinning on the launching pad of flying-saucer-pole; (B) Swiveling flying-saucer-pole to speed up the flying-saucer before launching, the angle of attack of the flying-sauce is negative; (c) Twisting the flying-sauce-pole to make the flying-sauce have the positive angle of attack; (D) Under the wind pressure, the flying-sauce takes off from the launching pad of flying-sauce-pole.

Figure 9:
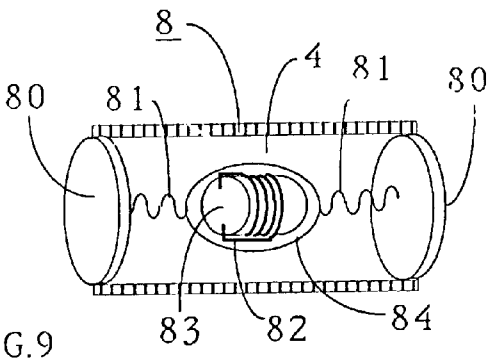
FIG. 9 is the vibration energized light emitting diode (LED) to flash the light in the night as the golf-flying-saucer glides in the sky.

FIG. 19 (A) is the tube segment of the vibration energized light emitting diode (LED) as shown in FIG. 9 with the face-to-face N—N magnets alignment; (B) is the tube segment of the vibration energized light emitting diode (LED) as shown in FIG. 9 with the face-to-face S—S magnets alignment; (c) is the multi-disciplinary approach to construct the concept tree for the vibration energized light emitting diode (LED); (D) is the enlarged view of the LED wrapped with the coil; (E) is the equivalent circuit of the inductor for the coil; (F) is the P-N diode and P-N junction of the LED; (G) is the equivalent circuit of the capacitor and diode for the LED; (H) is the sectional view of the coil cutting the radial magnetic field lines of FIG. 19A as the coil moves out of the paper; the induced current I flows in the counter-clockwise direction; (I) is the sectional view of the coil cutting the radial magnetic field lines of FIG. 19A as the coil moves into the paper; the induced current I flows in the clockwise direction; (J) is the sectional view of the coil cutting the radial magnetic field lines of FIG. 19B as the coil moves out of the paper; the induced current I flows in the clockwise direction; (K) is the section view of the coil cutting the radial magnetic field lines of FIG. 19B as the coil moving into the paper, the induced current I flows in the counter-clockwise direction; (L) is the equivalent circuit of the vibration energized light emitting diode(LED) as shown in FIG. 19C; (M) is the voltage-time transient curve for the equivalent circuit as shown in FIG. 19L.

Figure 14:
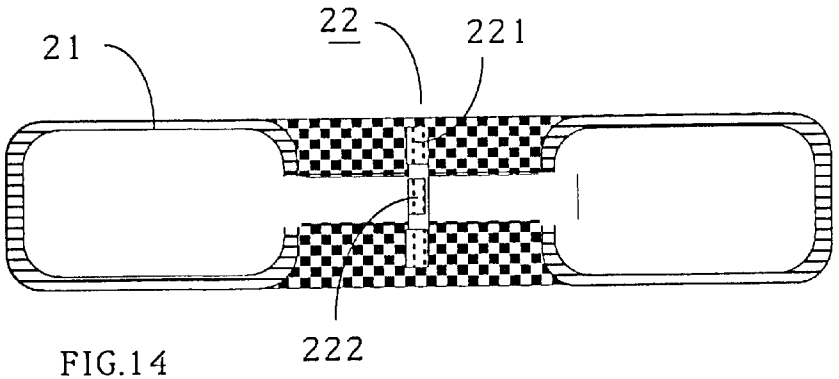
FIG. 14 is the side view of the shiny harmonica-whistle taken at Y—Y section in FIG. 13.
Figure 20A:
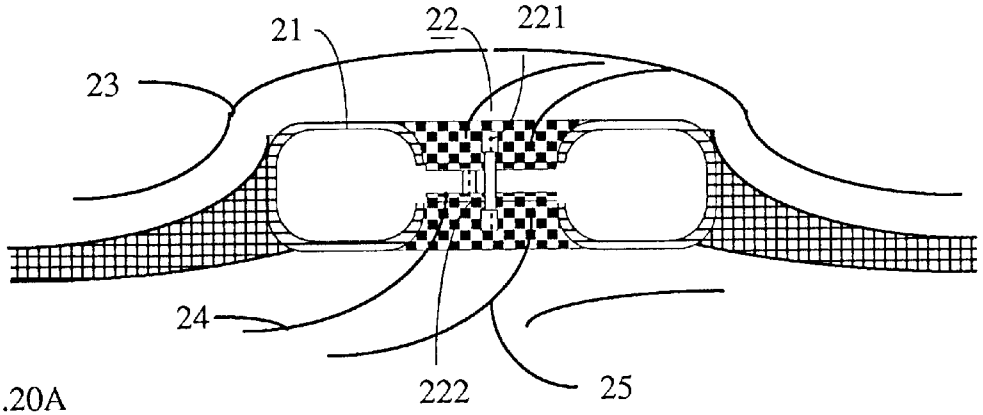

FIG. 20 (A) is the pattern of air flow around the harmonica-whistle as shown in FIG. 14; (B) is the block diagram of the positive feedback loop of the acoustic resonator of the harmonica-whistle as shown in FIG. 20A.

DESCRIPTION AND OPERATION

The flying-sauce-golf is to launch the flying-saucer with the flying-saucer-pole. To increase the throwing distance of the flying-saucer, both angular momentum and linear momentum need to be increased a lot with the flying-saucer-pole. To increase the angular momentum, the flying-saucer spins very fast on the launching pad of the pole before it is thrown out. To increase the linear momentum, the tangential velocity of the swiveling circle is very high. To increase the tangential velocity of the swiveling circle, the radius of the swiveling circle is large and the swiveling velocity is high. As shown in FIG. FIG. 2, the golf-flying-saucer 1 sits and rotates on the launching pads 72 of the flying-saucer-pole 70. The radius of swiveling circle, the length of flying-saucer-pole, can be adjusted with the latching cam 702.

Figure 1:
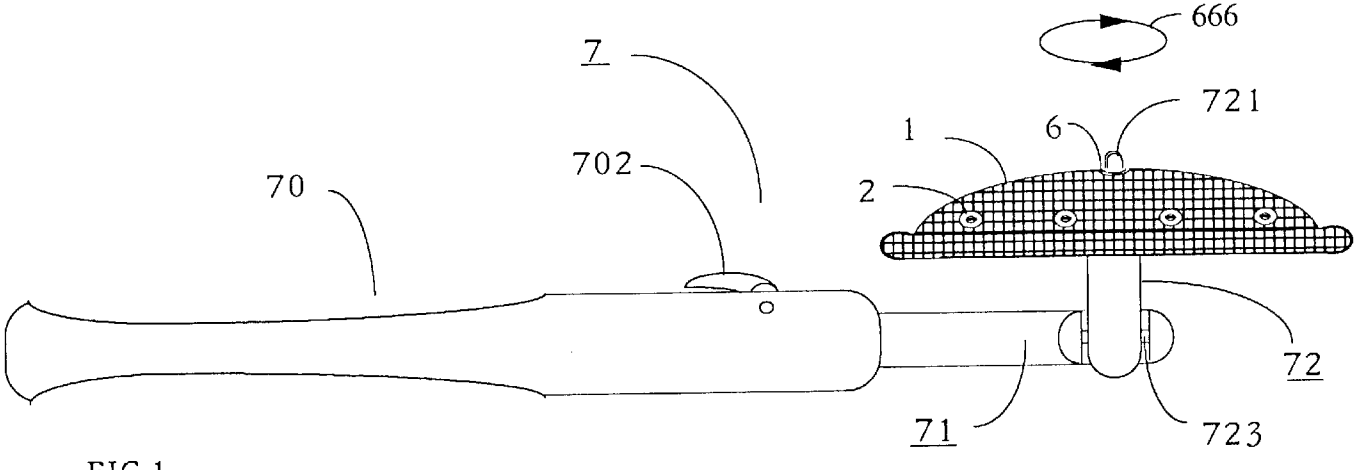
FIG. 1 is the elevated view of the golf-flying-saucer spinning on the launching pad of flying-saucer-pole.
Figure 2:
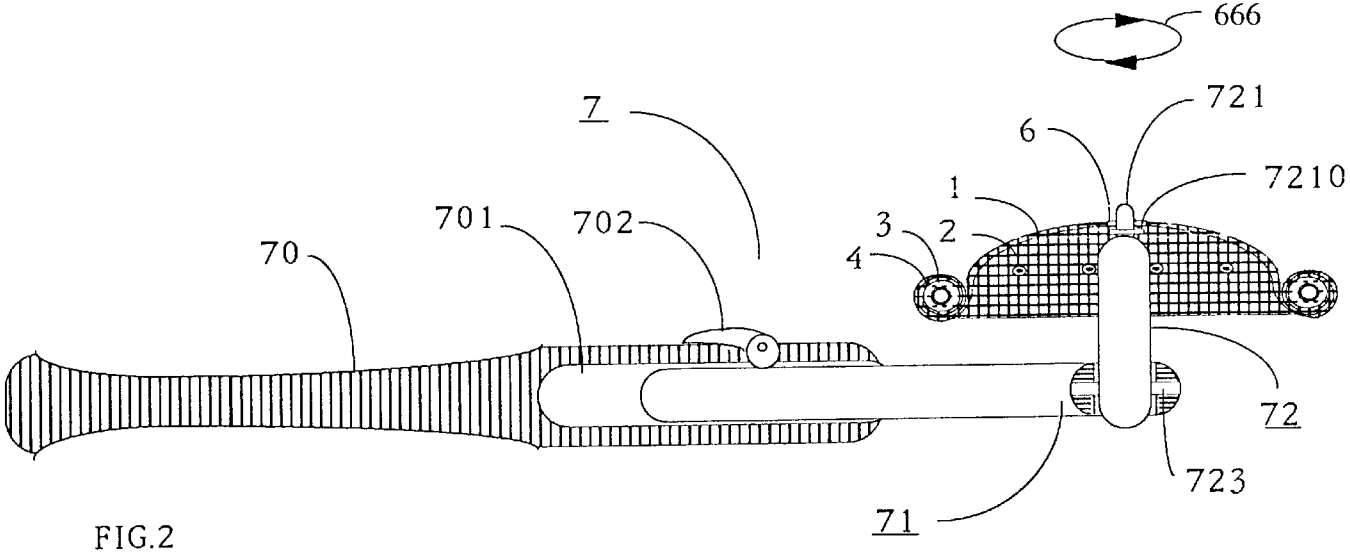
FIG. 2 is the sectional view of the golf-flying-saucer spinning on the launching pad of flying-saucer-pole.

The flying-saucer can fly much higher with the swivel of the flying-saucer-pole. As shown in FIG. FIG. 2, the golf-flying-saucer 1 sits on the spinning axle 721 of the flying-saucer-pole 7 to spin. FIG. 2 shows the section view of the golf-flying-saucer 1 and flying-saucer-pole 7. The flying-saucer-pole 7 is constituted of the pole body 70, the extension pole 71 and the flying-saucer launching pad 72. According to the player's height, the length of the flying-saucer-pole 7 can be adjusted with the extension pole 71. Pulling up the latch handle 702, the latching cam 702 releases the extension pole 71. Then the extension pole 71 can slide in-and-out in the pole 70 freely. The player adjusts the length of the pole 7, then pushes down the latching cam 702 to lock the extension pole 71. The latching cam 702 latches the extension pole. The length of the flying-saucer-pole 7 is set to be the ideal length for the player.

Figure 4:
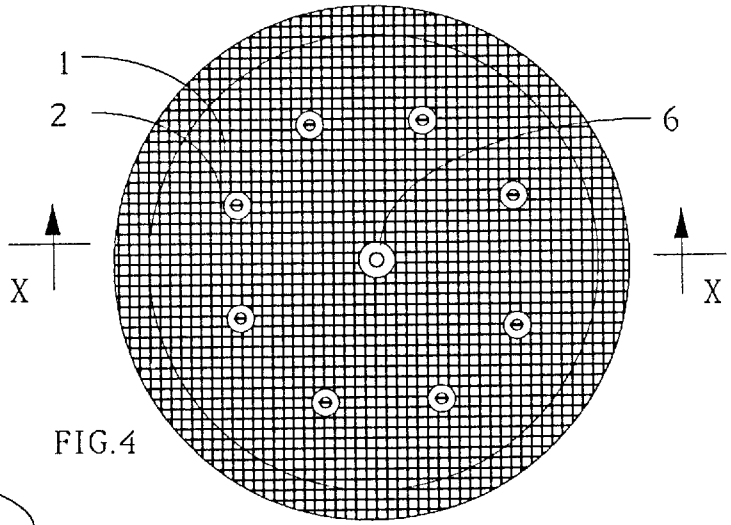
FIG. 4 is the top view of the golf-flying-saucer.
Figure 3:
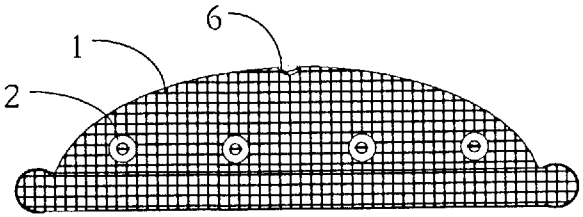
FIG. 3 is the side view of the golf-flying-saucer.
Figure 5:
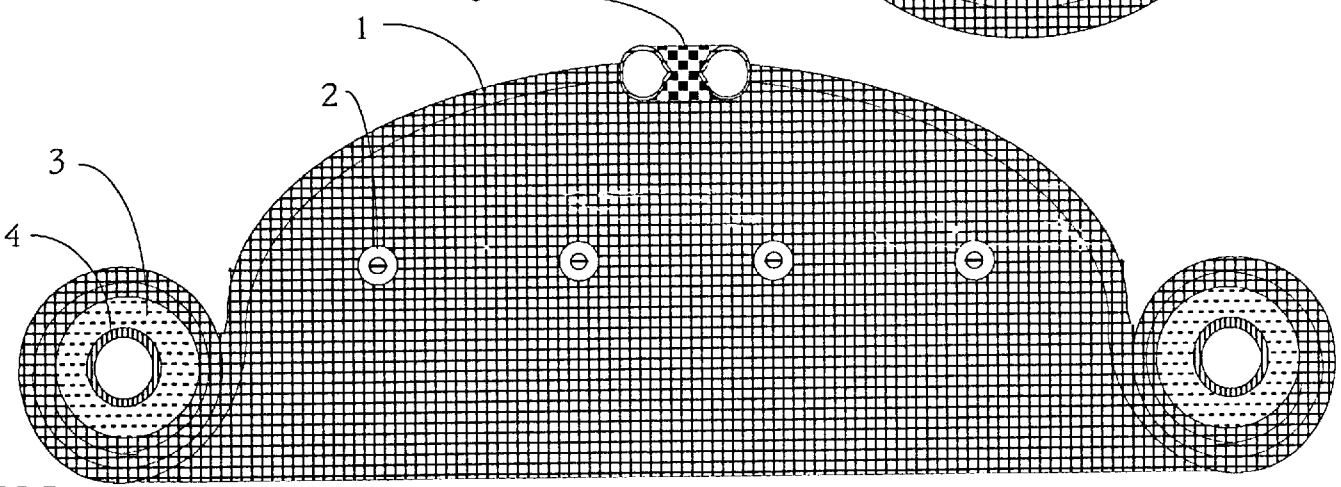
FIG. 5 is the sectional view of the golf-flying-saucer taken at the section line X—X in FIG. 4.
Figure 6:
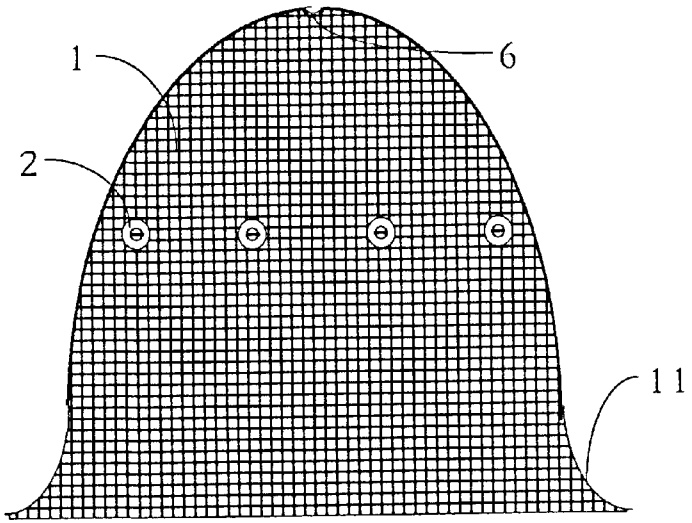
FIG. 6 is the side view of the flexible hat body of the golf-flying-saucer.
Figure 8:
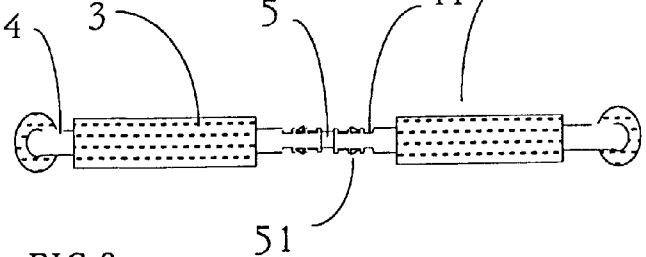
FIG. 8 is the side view of the adjustable ring band.
Figure 18A:
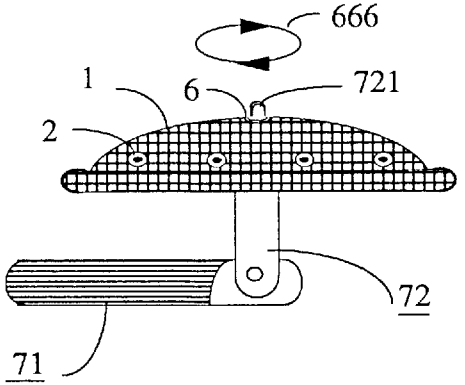
Figure 18B:
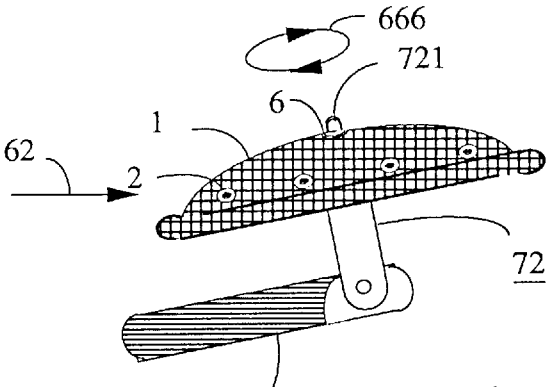
Figure 18C:
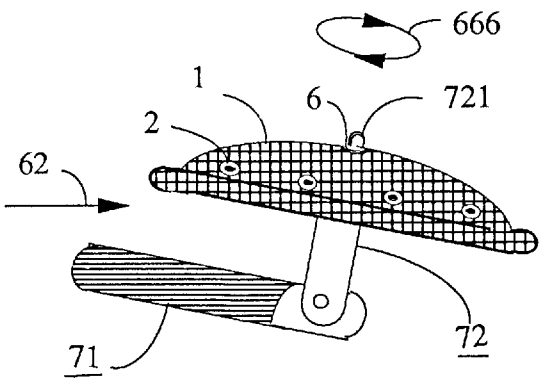
Figure 18D:
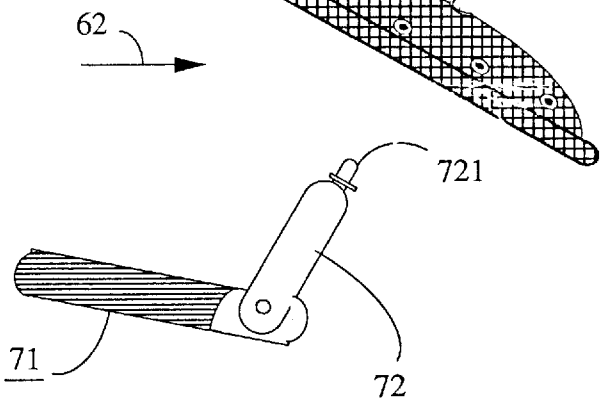

In FIG. 18A, as illustrated by the ellipse 666, the player first uses hand to turn the golf-flying-saucer 1 to spin at high speed on the launching pad 72 of the flying-saucer-pole 7. Then the player swivels the flying-saucer-pole 7 with the negative angle of attack at high speed as shown in FIG. 18B. The arrow 62 shows the direction of the relative wind. As the player wants to throw the golf-flying-saucer 1 out, as shown in FIG. 18C, all he needs to do is to turn the flying-saucer-pole 7 with a little twist of the wrist to increase the angle of attack. The golf-flying-saucer 1 will take off to fly in the sky as shown in FIG. 18D. The increment of the angle of attack increases the lift force and the golf-flying-saucer will take-off as the airplane does. The extension bar 71 can be pulled out or pushed in to adjust the swiveling radius. The flying saucer launching pad 72 is swiveled to launch the golf-flying-saucer 1 at an angle of attack. As shown in FIG. 3 and FIG. 4, the golf-flying-saucer 1 has the shiny harmonica-whistles 2 and the fitting hub 6. In the sky, the air flows through the hole of fitting hub 6 just as the parachute does. The fitting hub 6 stabilizes the flying-saucer during the free-motion dropping process. To throw the flying-saucer to a much farther distance, the golf-flying-saucer 1 needs to have some weight The weight is the adjustable ring band 9. The adjustable ring band 9 may be made of the plastic tube. Considering the safety for catching the flying-saucer with the head, the ring band 9 is wrapped around with the soft foam 3. To fit heads having the different sizes of the different players, the size of flying-saucer 1 can be adjusted with the flare 11 of flying-saucer 1 as shown in FIG. 6 and the adjustable ring band 9 as shown in FIG. 8. As shown in FIG. 5, the external wrap-around-flare 11 of the flying-saucer 1 wraps around the sliding soft foam 3 and adjustable ring band 9 externally. The soft foam 3 protects the head of player when the player can catch the flying-saucer 1 with his head. The foam 3 is mounted on the ring band 9. There is space between the two segments of the sliding foam 3 that the ring band 9 can adjust its ring size.

Figure 13:
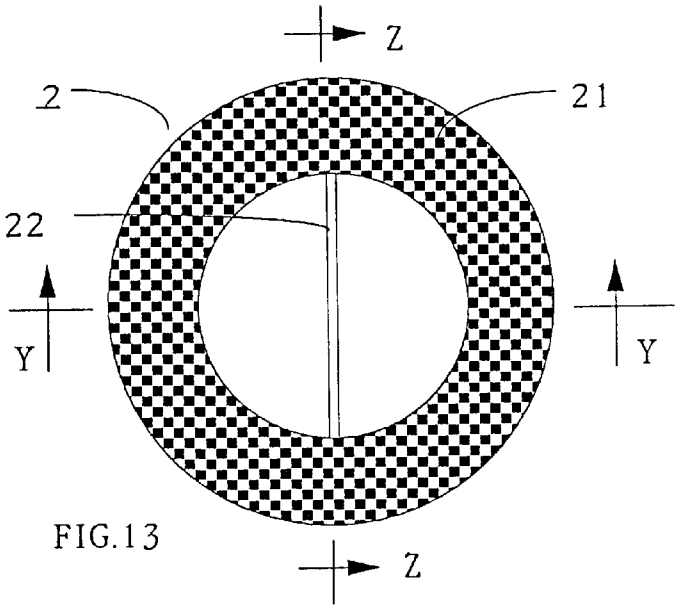
FIG. 13 is the top view of the shiny harmonica-whistle.
Figure 19K:
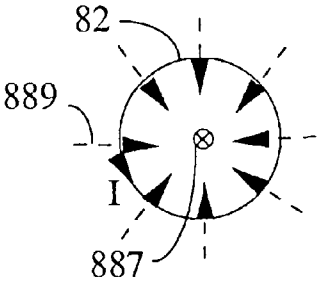
Figure 19J:
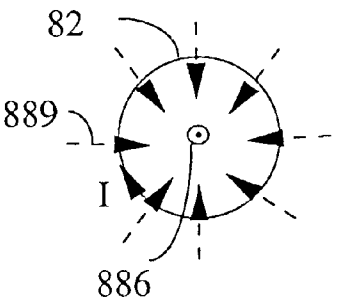
Figure 19I:
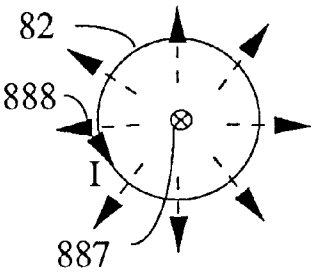
Figure 19H:
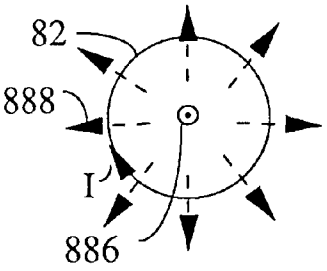
Figure 19M:
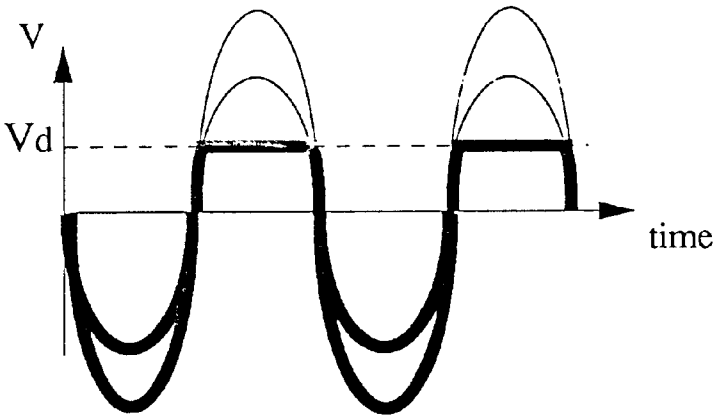
Figure 19L:
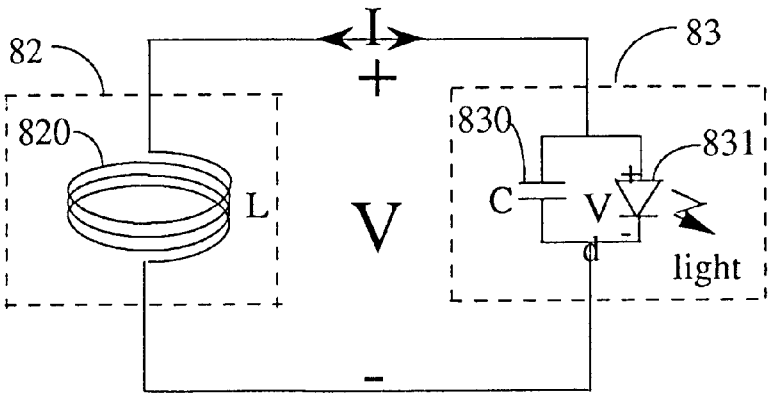

To have more fun, the golf-flying-saucer 1 has the multi-media effect. The golf-flying-saucer 1 slides in the sky with the shining rainbow light and the harmonica music sound in both day and night. In the daylight, as shown in FIG. 13, as the sunshine is reflected by the surface coating, the surface coating of harmonica-whistle 2 has the shining rainbow effect. In the night, as shown in FIG. 9, the integrated vibration-energized LED (light emitted diode) is installed in the tube of the ring band 9 and/or on the flying-saucer hat 1. However, to install in the ring band 9, the flare 11 of flying-saucer 1, the plastic locked tube 4 and the foam 3 have to be transparent. For a short segment inside the plastic tube 4, as shown in FIG. 9, the permanent magnetic 80 are installed inside the plastic tube 4. It needs only one magnet 80 in each segment. For two magnets 80, as shown in FIG. 19A or FIG. 19B, the two permanent magnets 80 need to have side with the same polarity to face each other. As shown in FIG. 19C, the LED 83 and the wire coil 82 are enwrapped in a transparent capsule 84. The capsule 84 is hanged with springs 81 to vibrate in the magnetic field between two magnets 80. As shown in FIG. 19D, it shows the equivalent circuit component inductor L 820 of the coil. The coil 82 has two functions. The first function is to serve as the coil of the tiny electric generator; the second function is to serve as the inductor 820 in the oscillator circuit as shown in FIG. 19K. FIG. 19E shows the physical diode structure of LED 83. As the capsule 84 vibrates, as shown in FIG. 19G and FIG. 19H or FIG. 191 and FIG. 19J, the wire coil 82 cuts the magnetic field lines and generates the electric voltage to power on the LED 83 as shown in FIG. 19K and FIG. 19L. The vibration-energized-LED is very simple. For example, we can use the 3 mm cylindrical LED lamp LTL-2211AT of LITEON Company wrapped with the lead wire 20 turns as the adjustable RF coils 48A518MPC of J. W. Miller Company does. The LED capsule 84 is the plastic form of polypropylene molded around an accurately positioned winding. J. W. Miller Company provides the entire necessary customer winding service and molding service.

However, to understand and design the vibration-energized-LED needs the multi-disciplinary study. So, the operational principles are explained in details for the reader who is not familiar with the conversion of vibration energy to electrical energy. This is the compact design, which merges the electrical circuit with the electrical power generator. The load LED is no more pure load. The load LED is part of the active resonator circuit. It needs the multi-disciplinary approach. As shown in FIG. 19C, the vibration energized LED 8 is constituted of magnet 80, coil 82 and LED 83. The magnet 80 provides both framing and magnetic field functions. The coil 81 and 82 has the spring 81, wire looping 82 and inductor L 820 functions. The mechanical engineer will use the magnet 80 as the frame; the electrical engineer will use the magnet 80 as the magnet for the magnetic field. The mechanical engineer uses the coil as the spring 81; the electrical power engineer uses the coil as the wire loop 82. As shown in FIG. 19E, the electrical circuit design engineer considers the coil 82 as the inductor 820. The mechanical engineer considers the LED 82 as the mass and the core of coil. As shown in FIG. 19F and FIG. 19G, the electrical engineer considers the LED 82 as the capacitor 830 connecting in parallel with the voltage clamping diode 831. However, the optoelectronic engineer considers the LED 82 as the electrical/optical conversion device. The mechanical engineer combines the frame, the spring and the mass to make a vibration resonator. The electrical power engineer combines the magnetic field and wiring loop to make the electrical power generator. The electrical circuit engineer combines the inductor 820, the capacitor 830 and the diode 831 to make an electrical resonator. The electrical-mechanical inter-disciplinary engineer combines the vibration resonator and the electrical power generator to do the vibration/electricity conversion. Finally, the mechanical-electrical-optoelectronic inter-disciplinary engineer combines of the vibration/electricity conversion and the electricity/light conversion into the vibration/light conversion. As shown in FIG. 19D, the coil comprises the spring 81 and the wiring loop 82. As shown in FIG. 19E, the wiring loop not only serves as the wire loop in the electric power generator but also serves as the inductor L 820 in the electric resonator circuit. As shown in FIG. 19F, the LED 83 is a PN diode with the PN junction 8301 and 8302. Due to the drift of the carriers of electron and hole, there are the positive space charges in the N side depletion region 8302 and the negative space charge in the P side depletion region 8301. There is the electric field in the PN junction. The spatial charge constitutes the capacitor C 830. As shown in the FIG. 19G, the equivalent circuit of the LED is the parallel connection of the capacitor 830 and the diode 831 having the diode voltage Vd.

Figure 7:
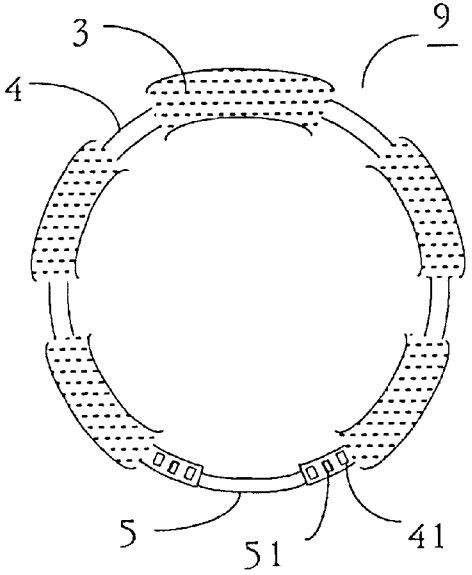
FIG. 7 is the top view of the adjustable ring band of the golf-flying-saucer.
Figure 12A:
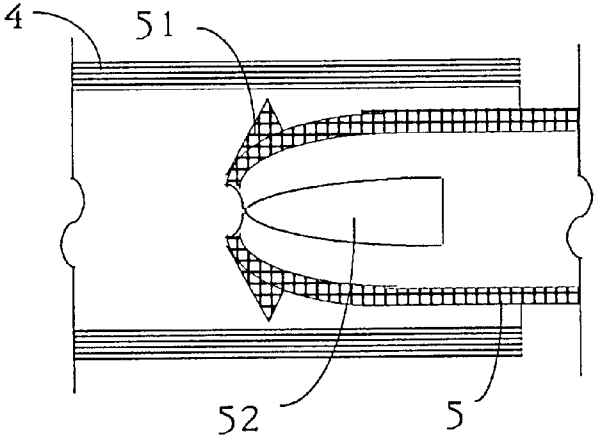
FIG. 12 (A) shows the knot of the locking tube sliding in the locked tube; (B) shows the knot of the locking tube fitting in the knothole of the locked tube.
Figure 12B:
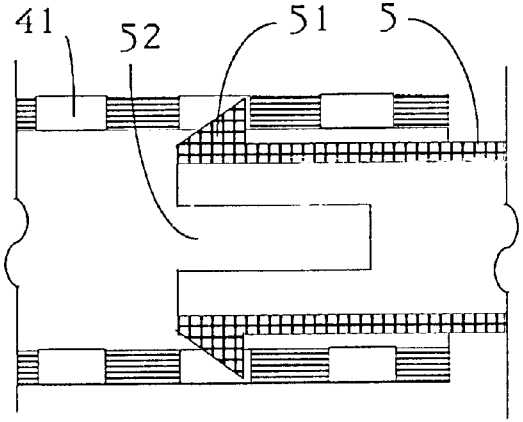
Figure 11C:
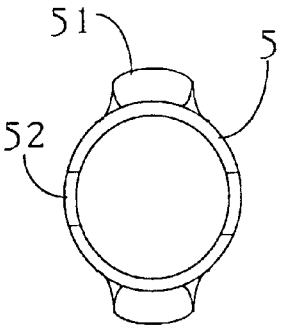
FIG. 11 (A) is the top view of the knot of the locking tube for the adjustable ring band; (B) is the side view of the knot of the locking tube for the adjustable ring band; (C) is the elevated view of the end of the locking tube.
Figure 10A:
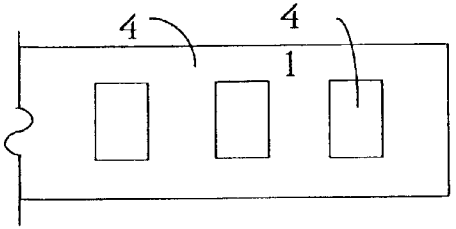
FIG. 10 (A) is the top view of the knothole of the buckle on the locked tube for the adjustable ring band; (B) is the side view of the knothole of the buckle on the locked tube for the adjustable ring band.
Figure 10B:
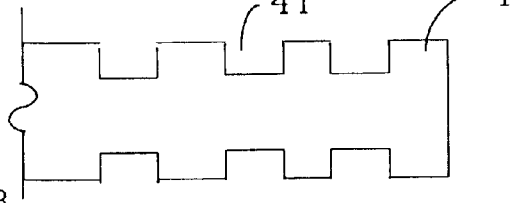
Figure 11A:
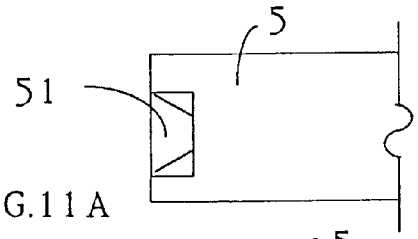
Figure 11B:
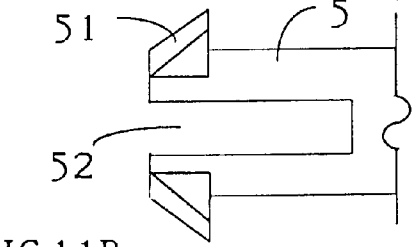
Figure 15:
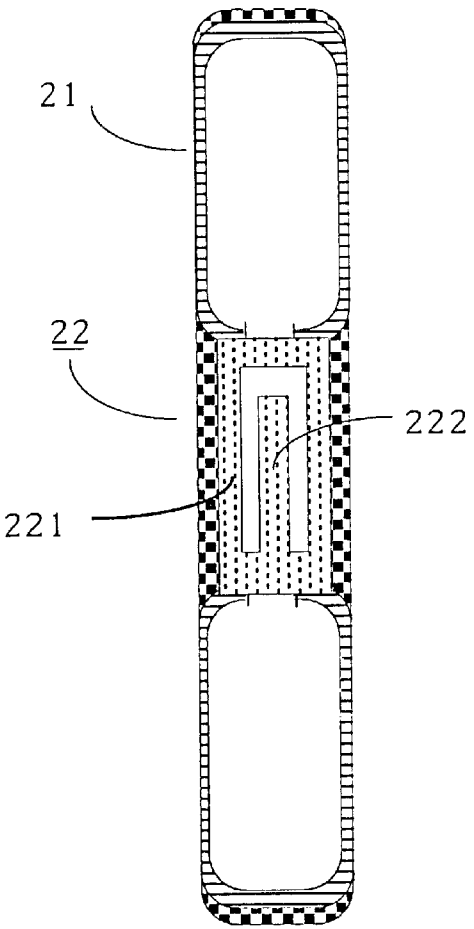
FIG. 15 is the side view of the shiny harmonica-whistle taken at Z—Z section in FIG. 13.

In FIG. 19A, the tube segment 8 has the North poles of magnets 80 face to face aligned. In FIG. 19B, the tube segment 8 has the South poles of magnets 80 face to face aligned. As the LED capsule 84 vibrates in the tube segment 8 as shown in FIG. 19A, the wiring loops 82 cut the magnetic field as shown in FIG. 19H and FIG. 191. The magnetic field line 888 is outward bound in radial direction. As the LED capsule vibrates in the tube segment 4 as shown in FIG. 19B, the wiring loops 82 cut the magnetic field as shown in FIG. 19J and FIG. 19K. The magnetic field line 889 is inward bound in radial direction. As the LED capsule 84 vibrates back and forth inside the tube segment with the radial magnetic field, both alignments have the same back and forth current flow generated. The mechanical vibration resonator is constituted of the mass of LED capsule 84, the spring 81 of coil and the frame of magnets 80. Under the external disturbance of flying disk I, the LED capsule 84 vibrates in the tube segment 8. In FIG. 19H, the wiring loop 82 moves upward out of the paper as shown by the arrow 886. In FIG. 19I, the wiring loop 82 moves downward into the paper as shown by the arrow 887. In FIG. 19J, the wiring loop 82 moves upward out of the paper as shown by the arrow 886. In FIG. 19K, the wiring loop 82 moves downward into the paper as shown by the arrow 887. According to the physical law, as the wiring loops 82 cut the magnetic field, it will induce the electrical force to drive the electrons to flow. It induces the current I. As the moving direction of the wiring loop reverses, the induced current I reverses its direction, too. This back-and-forth vibration of the mechanical resonator causes the current I to flow back and forth. As shown in FIG. 19L, the back-and-forth current flow I stimulates the LC electrical oscillator to resonate. As shown FIG. 19M, as the electrical resonator resonates, the voltage varies in the form of sinusoidal wave and is clamped by the diode voltage Vd on one side. The more turns of the wiring loop, the higher the oscillatory voltage V is and the larger the peak voltage is. As shown in FIG. I, as the player tuns the golf-flying-saucer 1 to rotate on the flying-saucer-pole 7. It induces the vibration energy to the golf flying-saucer 1. It energizes the vibration energy of the spring 81 and the LED 83 starts to flash. In the sky, the turbulent air flow continues energizing the vibration energy in the spring 81 to flash the LED 83. In the night, as the golf-flying-saucer 1 glides in the sky, the golf-flying-saucer 1 flashes the rotating rainbow like color light circle. To catch the golf-flying-saucer 1 with head, the flying-saucer needs to adjust its size for the opponent's head size. To adjust the ring size of the ring band 9, the novel tube interlock mechanism is invented. As shown in FIG. 7 and FIG. 8, the ring band 9 is made of the locked tube 4 and the locking tube 5. The tube interlock mechanism is made of the knothole 41 and the knot 51. As shown in FIG. 12A and FIG. 12B, the operation of the tube interlock mechanism is just twist and slide. By twisting the tube ninety degrees and sliding in-and-out the tubes, the interlock mechanism is easily locked and unlocked. As shown in FIG. 10A and FIG. 10B, the knotholes 41 are notched on the locked tube 4. As shown in FIG. 11A, FIG. 11B and FIG. 11C, the knots 51 are at the tip of the locking tube 5 in the transversal radial direction. In the tube longitudinal direction, there are two long cuts 52 at the end of the locking tube 5. The cut enables the locking tube 5 to have the spring effect to engage and disengage the interlock mechanism. With the ninety degrees twist angle, the operation of the adjustable ring band 9 with the locked tube 4 and the locking tube 5 can be explained with the different combinations of the figures. Combining FIG. 10A with FIG. 11B to be FIG. 12A, it shows the locking tube 5 sliding inside the locked tube 4. Combining FIG. 10B with FIG. 11B to be FIG. 12B, it shows the knot 51 fitting in the knothole 41 in the buckle-up position. To buckle-up, as shown in FIG. 12A, the first step is to twist locking tube 5 with ninety degrees. The 2nd step is to slide the locking tube 5 in the locked tube 4. The 3rd step is to twist back the locking tube 5 with ninety degrees to fit the knot 51 in the knotholes 41 of the ring band tube 4. To unbuckle and adjust the size of the ring band 9, the 1st step is to twist the locking tube 5 with ninety degrees rotation. As shown in FIG. 11A and FIG. 11C, there are inclining wedge type faces at the side of the knot 51. The longitudinal cut 52 makes the resilient locking tube 5 easily to be distorted to fit inside the locked tube 4. It is pretty easy to squeeze the knot 51 inside the locked tube 4 as shown in FIG. 12A. The 2nd step is to slide the locking tube 5 in the locked tube 4 to adjust the size of the ring band 9. The 3rd step is to twist the locking tube 4 to rotate ninety degrees back and fit the knot 51 in the knothole 41 at the new position.

Figure 20B:
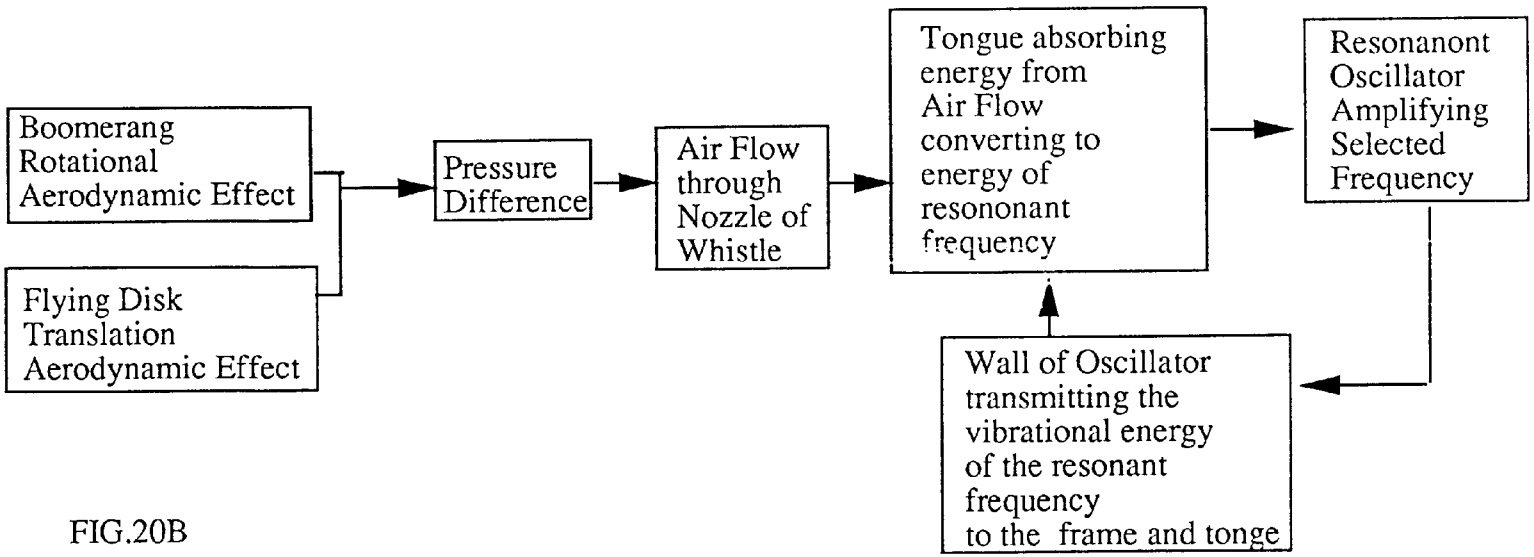

To have fun, the golf-flying-saucer 1 is further decorated with the shining harmonica-whistle 2. As shown in FIG. 13, the outside of the whistle 2 is coated with light reflective means 21 to generate the rainbow like color light. As shown in FIG. 20A, the air flows through the nozzle inside the harmonica-whistle 2. The vibrator 22 is mounted in the nozzle. The frame 221 of the vibrator 22 is attached to the inside wall of the resonator 21. The frame 221 is to protect the vibrating tongue 222. The vibrating tongue 222 is in the middle of the wind tunnel of the shining harmonica-whistle 2. The flying-saucer is in the foil shape. According to the physical law, as the airfoil moves with the positive angle of attack, the pressure at the top side of the flying saucer is less than the pressure at the bottom side. Under the difference of air pressure, the air flows from the bottom side to the upper side through the nozzle of the whistle. As shown in FIG. 20B, the wind flows through the nozzle of the shining harmonica-whistle 2, the vibrating tongue 222 vibrates to generate sound. The sound wave builds up the standing wave in the resonator 21 and the resonator 21 amplifies the sound. The harmonic vibrations of the resonator 21 feedback to the vibrating tongue 222. This process is a positive feedback loop. The positive feedback causes the vibrating tongue 222 to oscillate and drain more energy from the wind. The length of the vibrating tongue 222 determines the sound frequency. Changing the length of the vibrating tongue 222, the frequency of harmonica sound changes. On one golf-flying-saucer 1, every harmonica-whistle 2 has different length of vibrating tongue 222. There are harmonic relationships among the frequencies of the different harmonica-whistle 2.

Figure 16A:
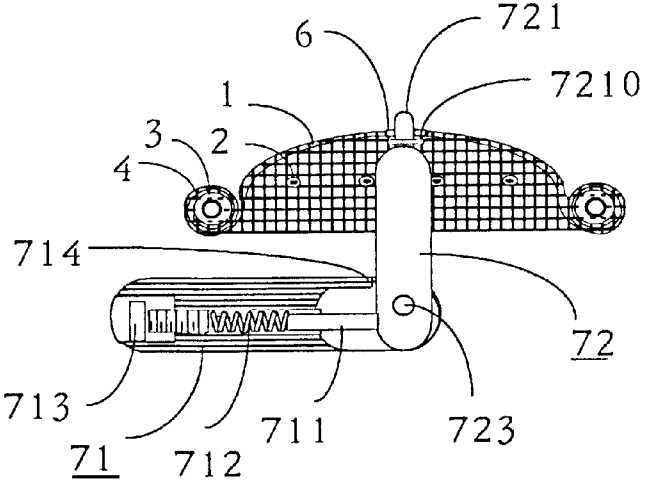
FIG. 16 (A) shows the flying-saucer launching pad pivotally mounted on the extension pole of the twisted Z-shape flying-saucer-pole; (B) the top sectional view of extension pole shows the extension pole being in L-shape to launch the golf-flying-saucer.
Figure 16B:
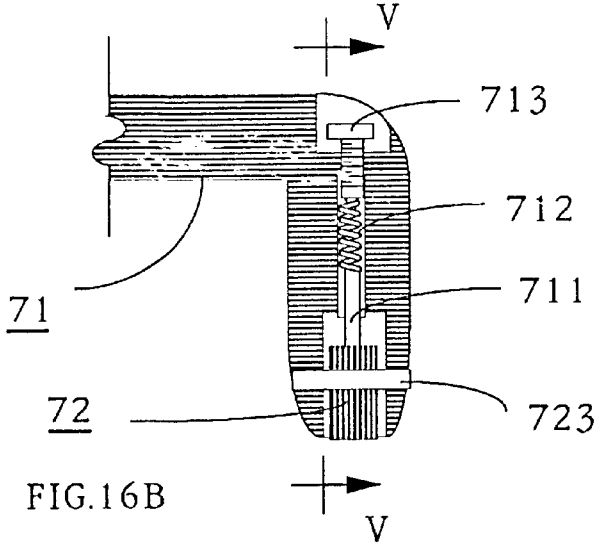

Comparing FIG. 18C with FIG. 18D, the flying saucer launching pad 72 needs to swivel to adjust its pose to have the smooth take-off of the golf-flying-saucer 1. To launch the golf-flying-saucer in the tangential direction of the swiveling circle, as shown in FIG. 16A and FIG. 16B, the extension bar is in Z-shape. The swiveling motion of the flying saucer launching pad 72 is in the tangential plane of the swiveling circle. As shown in FIG. 18D, adjusting the flying-saucer-pole 7 with a little twist of the wrist, the angle of attack of the golf-flying-saucer 1 changes a lot to start the take off process. FIG. 16B is the top view of the extension bar 71 to show the Z-shape structure. The bias spring 712 and the sliding pin 711 bias the flying-saucer launching pad 72 to the normal vertical position. Similar to the take-off of the airplane, as the golf-flying-saucer 1 takes off at an angle, under the lift force and drag force, the launching pad 72 will incline at an angle to let the golf-flying-saucer 1 take off as shown in FIG. 18D. The angle of attack of the golf-flying-saucer 1 is equal to the swiveling angle of the flying-saucer launching pad 72. The larger the angle of attack of the golf-flying-saucer 1 is, the larger the drag force is; the larger the drag force is, the larger the swivel angle of the flying-saucer launching pad 72 needs to be. Due to the drag force, the bias spring 712 biases against the flying-saucer launching pad 72 to allow the flying-saucer launching pad 72 to adjust the take off angle of the golf-flying-saucer 1 automatically. The swiveling angle of flying-saucer launching pad 72 is proportional to the drag force of the golf-flying-saucer 1. The adjusting screw 713 is to adjust the strength of the take-off bias spring 712. In the rest condition, the flying-saucer launching pad 72 is perpendicular to the extension pole 71. As shown in FIG. 16A, under the bias of spring 712, the swivel motion of the flying-saucer launching pad 72 is stopped by the launching pad stop 714 at the end of the extension pole 71 to have the vertical position.

Figure 17:
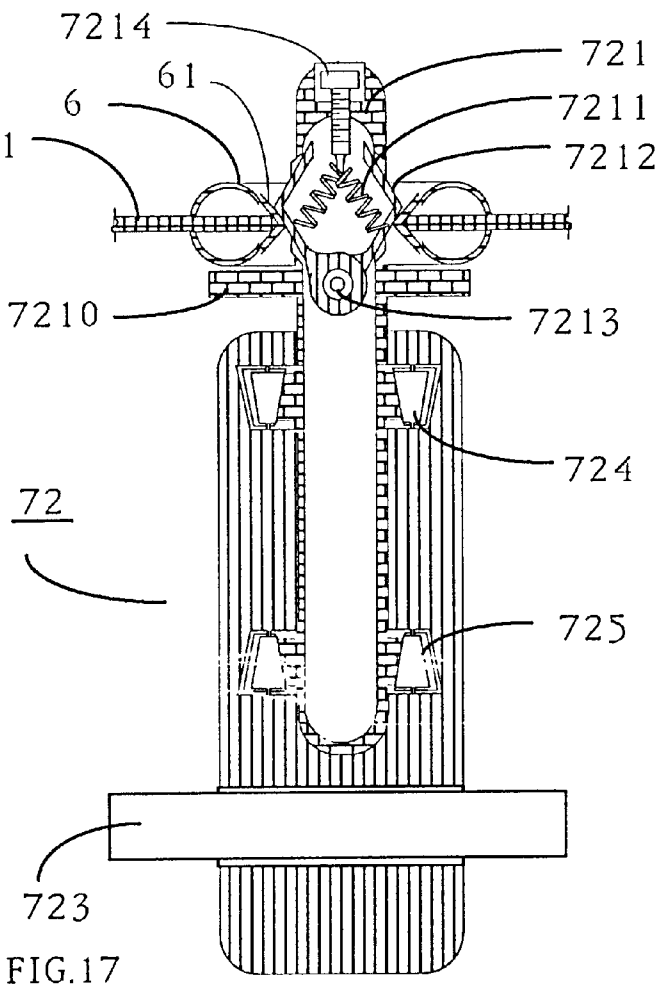
FIG. 17 is the sectional view of the flying-saucer launching pad of the flying-saucer-pole.

The flying-saucer launching pad 72 plays the most important role during the golf-flying-saucer 1 taking off process. FIG. 17 shows the detailed structure of the launching pad 72 of the flying-saucer-pole 7. The launching pad 72 is constituted of the spinning pole 721, the seat flange 7210, the holding keeper 7212, the swiveling axle 723, and the bearings 724 and 725. Before taking off, as shown in FIG. 18B, the golf-flying-saucer 1 spins on the flying-saucer launching pad 72 and the flying-saucer-pole 7 is swiveled at high speed. Before taking-off, the golf-flying-saucer 1 needs to be held to the spinning pole 721. The golf-flying-saucer 1 sits on the seat flange 7210 or the spinning axle 721 with the fitting hub 6 being held by the holding bias means 7212. The ring latch 6 has a rim of wedge 61. The rim of wedge 61 is under the bias of holding bias means 7212. The holding bias means 7212 is pivotally mounted on the axle 7213 and biased by the taking off spring 7211 to hold the fitting hub 6. The biasing force of the taking offspring 7211 will decide when to release the flying-saucer 1 and let the flying-saucer 1 go. The taking off screw 7214 is to adjust the biasing force of the spring 7211. As the flying-saucer-pole 7 swings at high speed, increasing the angle of attack of the golf-flying-saucer 1 a little, the lift force increases a lot. The inclining slope of the rim of wedge 61 will force the holding bias means 7212 to rotate pivotally to release the lock of the ring latch 61 that the spinning golf-flying-saucer 1 can take off. As the wedging force of rim of wedge 61 overcomes the bias force of the taking offspring 7211, the golf-flying-saucer 1 is released and speeded up by the holding bias means 7212. The lift force of the golf-flying-saucer 1 not only causes the holding bias means 7212 to release the flying-saucer 1 but also forces the flying-saucer launching pad 72 to swivel to launch the flying-saucer hat at the optimum take-off angle. This is very complicated, accurate and high speed operation. All the operations are accomplished by the complicated mechanism in the launching pad 72 of the flying-saucer pole 7. The flying-saucer-golf sport combines the flying-saucer, baseball and soccer with golf game. The game of flying-saucer-golf completely changes the way of golf game. It is impossible for the golf player to catch the dangerous golf ball with hand, not to mention with head. The golf ball is single player game. You can swing the flying-saucer pole 7 as the baseball player or golf player does. You can catch the golf flying-saucer 1 with hand as the flying-saucer player or baseball player does. You can also catch the flying-saucer hat 1 with head as the soccer player does. It is fun and safe game for the team players.

While the invention has been particularly shown and described with reference to the preferred embodiments thereof, it will be understood by those skilled in the art that various changes in form and details may be made therein without departing from the spirit and scope of the invention.

I claim:

1. A multi-media adjustable variable-size-flying-saucer-golf game system comprising a flying-saucer pole means and flying-saucer means, said flying-saucer pole comprising a pole and a launching pad means; said launching pad being at one end of said flying-saucer pole said launching pad further comprising a spinning axle means, said flying-saucer further comprising a fitting hub means in a middle of said flying-saucer means, said flying-saucer spinning on a launching pad of said flying-saucer pole with said fitting hub being fitted on said spinning awe means of said flying-saucer launching pad;

first turning said flying-saucer to rotate, said flying-saucer spinning very fast on said launching pad, then swiveling said flying-saucer pole many cycles to launch said variable size flying-saucer to fly;

as swiveling said pole with a negative angle of attack of said flying-saucer, said flying saucer not taking off, twisting said pole with a small angle to adjust an angle of said flying-saucer to have a positive angle of attack, said flying-saucer producing lift force and taking off from said launching pad means as an airplane doing.

2. A multi-media adjustable variable-size-flying-saucer-golf game system according to claim 1 said launching pad further comprising a swiveling axle means and a biasing spring means;

said launching pad being pivotally mounted on said flying-saucer pole with a swiveling axle means;

said biasing spring means having one end biasing against said pole and having other end biasing against said launching pad, as said lift force increasing, under a drag force induced by said lift force, said launching pad swiveling at an angle and biasing against said second spring means; said angle being proportional to said lift force; said angle making said flying-saucer taking off smoothly.

3. A multi-media adjustable variable-size-flying-saucer-golf game system according to claim 1 said flying-saucer pole is in a twisted Z-shape, said Z-shape flying-saucer pole being composed of said launching pad and an L-shape pole; said launching pad means being at end of said L-shape pole and being in one angle to said L-shape pole;

said variable-size-flying-saucer launching pad swiveling direction being in the tangential plane of the swiveling circle of said variable-size-flying-saucer pole.

4. A multi-media adjustable variable-size-flying saucer-golf game system according to claim 1 said flying-saucer launching pad further comprising a holding keeper means; said holding means being pivotally mounted on said launching pad; said holding means having functions of bias and keeper; under biasing force of said holding means, said holding means biasing against said fitting hub means of said variable-size-flying-saucer to hold said variable-size-flying-saucer to said launching pad;

before launching said variable-size-flying-saucer, said spinning axle means spinning together with said variable-size-flying-saucer; during swiveling said flying-saucer pole, as said angle of attack being positive and lift force of said variable-size-flying-saucer increasing, said lift force overcoming said biasing force of said holding means, said holding means releasing said variable-size-flying-saucer and said variable-size-flying-saucer taking off under said lift force from said launch pad means, said holding keep means being pivotally mounted on said launching pad;

said holding keeper means further comprising holding bias means;

under biasing force of said holding biasing means, said holding keeper means biasing against said fitting hub means of said flying-saucer to hold said flying-saucer to said launching pad said holding keeper holding said flying-saucer to spin on said flying-saucer launching pad before launching said flying-saucer to take off from said variable-size-flying-saucer launching pad; before launching said flying-saucer, said spinning axle means spinning together with said flying-saucer; during swiveling said flying-saucer pole, as said angle of attack being positive and a lift force of said flying-saucer increasing, said lift force overcoming said biasing force of said holding bias means, said holding keeper means releasing said flying-saucer and said flying-saucer taking off under said lift force from said launch pad means.

5. A multi-media adjustable variable-size-flying-saucer-golf game system according to claim 1 said flying-saucer pole further comprises an extension pole means and latching means, said launching pad being mounted at end of said extension pole means, said latching means being mounted on said flying-saucer pole to latch said extension pole; releasing a latch means, said flying-saucer pole being able to adjust its length, said extension pole means being able to slide in-and-out to change length of said flying-saucer pole according to a need of individual player.

6. A multi-media adjustable variable-size-flying -saucer-golf game system according to claim 1, said flying-saucer further comprising a variable-size-flying-saucer with a bell shape body means and an adjustable ring band means, said adjustable ring band means being composed of a plurality of tube means and said adjustable ring band means being adjustable; one end of said tube means being able to slide in an other end of a neighboring said tube means, adjusting the length of overlapping portion of said tube means, said adjustable ring band means being able to adjust a size of said adjustable ring band means;

said bell shape body being one unit piece; a flare portion of said bell shape body wrapping around said adjustable ring band means to form said variable-size-flying-saucer; as said adjustable ring band means being adjusted to be a new size, said flare portion of said bell shape body means wrapping around said adjustable ring band means several turns to be a new size of flying-saucer, a smaller size of said variable-size-flying-saucer needing to have said flare portion wrapping around said adjustable ring band means more turns; since said bell shape body means being one unit piece that said size of said variable-size-flying-saucer varying continuously and having a range of different sizes of said variable-size-flying-saucer;

said variable-size-flying-saucer being able to be thrown as a flying-saucer and be worn as a hat; said variable-size-flying-saucer further being able to be played as a flying-saucer and being caught with a player's head.

7. A multi-media adjustable variable-size-flying-saucer-golf game system according to claim 6, said adjustable ring band means further including interlocking means, said interlocking means being composed of locking means and locked means to interlock said tube means with each other;

said locking means being located at one end of said tube means and said locked means being distributed on said tube means;

adjusting size of said adjustable ring band with sliding of one end of said tube means in a other said tube means, said locking means interlocking with said locked means on said tube means; the size of said variable-size-flying-saucer being adjusted accordingly;

said interlocking means fixing said size of said variable-size-flying-saucer that said size not changing during operations of said flying-saucer.

8. A multi-media adjustable variable-size-flying-saucer-golf game system according to claim 7, said foam means are in segments and sliding on said adjustable ring band to adjust the size of said variable-size-flying-saucer;

as said adjustable ring band means changing size, said foam means needing to be rearranged to have the even distribution of said foam means on said adjustable ring band means, it being critical for performance of said variable-size-flying-saucer.

9. A multi-media adjustable variable-size-flying-saucer-golf game system according to claim 7, said adjustable ring band means further comprises a foam means wrapping outside of said adjustable ring band;

said flare of bell shape body means wrapping around said foam means;

said foam means serving as buffer to protect other object from damages and making said variable-size-flying-saucer having a shape of air foil to increase the lift force of said variable-size flying-saucer.

10. A multi-media adjustable variable-size-flying-saucer-golf game system according to claim 9, said locking means further comprises a knot means at end of said locking means, said locked means further comprising knothole being notched on said locked means; as said knot means fitting inside said knothole, said adjustable ring band being interlocked to a new size for said adjustable ring band, as said flare portion wrapping around said adjustable ring band, said variable-size-flying-saucer having a new size accordingly.

11. A multi-media adjustable variable-size-flying-saucer-golf game system according to claim 10, said locking means further comprises longitudinal cuts at an end of said locking means, said locking means being made of resilient material that said locking means being able to be distorted in shape and size to slide in said locked means;

for said tube means having similar radius dimension to fit tightly, said longitudinal cut making a change of size of said locking means easier and faster; said knot means having larger radius dimension than said inner dimension of said locked means to interlock in said knothole, with said longitudinal cut, said knot means being able to change radius dimension to slide in said locked means to change from one interlocking position to another interlocking position;

said longitudinal cut providing a changing capability for a radial direction to adjust said adjustable ring band means.

12. A multi-media adjustable variable-size-flying-saucer-golf game system according to claim 6 further comprises harmonica-whistle means attaching on said variable-size-flying-saucer, said harmonica-whistle comprising a resonant cavity and a nozzle means; said resonant cavity having opening connecting to said nozzle; as air flowing said nozzle generating sound; said sound propagating into said resonant cavity through said opening; said resonant cavity amplifying a whistling sound induced by said air flowing through said nozzle.

13. A multi-media adjustable variable-size-flying-saucer-golf game system according to claim 12, said harmonica-whistle further comprising a vibrating tongue, said vibrating tongue being mounted in said nozzle with a frame means attached to a wall of said resonant cavity;

as air flowing across said vibrating tongue, it generating sound being amplified by said resonant cavity; adjusting a length of said vibrating tongue changing a pitch of whistle sound.

14. A multi-media adjustable variable-size-flying-saucer-golf game system according to claim 6, said adjustable ring band means further comprises vibration energized LED;

said vibration energized LED comprising magnet means, spring means, wire coil means and light emitting diode means;

said wire coil wrapping around said light emitting diode means;

said wire coil having two terminals connecting to terminals of said light emitting diode means;

said spring means connecting to said vibration energized LED and said magnet means; as said wire coil means vibrating in a magnetic field of said magnet means, said wire coil means cutting magnetic field line of said magnet means to generate electric voltage to light up said light emitting diode means.

* * * * *